US006154928A

United States Patent [19]

Thom

[11] Patent Number: 6,154,928

[45] Date of Patent: Dec. 5, 2000

[54] GRIPPER ADAPTER FOR DOORKNOBS

[75] Inventor: Paul Thom, Montclair, N.J.

[73] Assignee: Bel-Art Products, Inc., Pequannock, N.J.

[21] Appl. No.: 09/223,361

[22] Filed: Dec. 30, 1998

[51] Int. Cl.[7] ..... E05B 1/04

[52] U.S. Cl. ..... 16/413; 16/414; 16/421; 16/DIG. 12; 16/DIG. 30; 292/DIG. 2; 292/DIG. 63

[58] Field of Search ..... 16/413, 414, 421, 16/DIG. 12, DIG. 30; 292/DIG. 2, DIG. 8, DIG. 63

[56] References Cited

U.S. PATENT DOCUMENTS

| | | | |
|---|---|---|---|
| D. 211,398 | 6/1968 | Hall . | |
| D. 329,590 | 9/1992 | Chapman . | |
| 1,410,605 | 3/1922 | Schacht . | |
| 2,100,818 | 11/1937 | Redman . | |
| 2,721,597 | 10/1955 | Pitrella . | |
| 2,731,056 | 1/1956 | Anson . | |
| 3,072,955 | 1/1963 | Mitchell . | |
| 3,249,990 | 5/1966 | Schlage . | |
| 3,313,057 | 4/1967 | Leddy . | |
| 3,427,680 | 2/1969 | Gilbert . | |
| 3,827,739 | 8/1974 | Overholser . | |
| 3,893,205 | 7/1975 | Anderson et al. . | |
| 3,909,878 | 10/1975 | Natinsky . | |
| 3,960,396 | 6/1976 | Miyahara . | |
| 3,965,529 | 6/1976 | Hadzimahalis . | |
| 3,995,650 | 12/1976 | DiVito . | |
| 4,000,539 | 1/1977 | Neyer . | |
| 4,094,210 | 6/1978 | Wirtz et al. . | |
| 4,223,931 | 9/1980 | Neary . | |
| 4,504,087 | 3/1985 | Pennington . | |
| 4,571,111 | 2/1986 | Keogh . | |
| 4,835,816 | 6/1989 | Graef . | |
| 4,971,375 | 11/1990 | Grecco . | |
| 4,972,545 | 11/1990 | Ozagir et al. . | |
| 4,999,875 | 3/1991 | Rybak . | |
| 5,008,551 | 4/1991 | Randolph . | |
| 5,231,733 | 8/1993 | Dittman | 16/114 R |
| 5,355,552 | 10/1994 | Huang | 16/111 R |
| 5,495,641 | 3/1996 | Going et al. . | |
| 5,701,635 | 12/1997 | Hawkes . | |
| 5,860,190 | 1/1999 | Cano | 16/114 R |

FOREIGN PATENT DOCUMENTS

| | | |
|---|---|---|
| 28 28 781 | 1/1980 | Germany . |

*Primary Examiner*—Anthony Knight
*Assistant Examiner*—Alison K. Pickard
*Attorney, Agent, or Firm*—Lawrence G. Fridman

[57] ABSTRACT

A device facilitating operation of a doorknob, comprising a tubular body member having a continuous wall with an outer gripping surface and an inner surface defining bore adapted for receiving the doorknob. A plurality of resiliently deformable projections extend inwardly from the inner surface of the wall. A distance between opposing projections before installation of the device on the doorknob is smaller than a cross dimension of the knob. Each projection has a pair of spaced end portions formed integrally with the inner surface of the wall. The outer gripping surface of the continuous wall includes a generally curved section between each pair of spaced end portions before the device is installed on the knob. Deformation of the projections upon installation of the device on the knob causes the spaced end portions of each projection to spread apart and embrace an outer periphery of the doorknob.

14 Claims, 3 Drawing Sheets

GRIPPER ADAPTER FOR DOORKNOBS

BACKGROUND OF THE INVENTION

1. Field of the Invention

This invention relates to doorknob accessories or the like, and more particularly to a device attachable to a doorknob so as to facilitate turning of the doorknob by a user.

2. Description of the Related Art

Many doorknobs are round in shape and sized to be conveniently grasped and turned by a hand of a user for opening a door. Although grasping and turning the doorknob is a simple task, various disabilities can make this task painfully difficult, if not impossible. For example, people suffering from arthritis in the wrist or hand may be unable to grasp the doorknob tightly enough to turn the knob, without incurring debilitating pain. Similarly, persons with severe hand deformities or others who have substantially lost use of the hand may be unable to grasp and turn the doorknob. These medical conditions may also adversely affect a person's ability to rotate other types of knobs as well, such as water knobs, etc.

In an effort to address this problem, various prior art solutions have been proposed. For example, U.S. Pat. No. 5,495,641 issued to Going et al. discloses an adapter for a doorknob that has an annular wall with a smooth inner surface and a plurality of levers and ridges formed on the outer surface. The adapter is installed over a doorknob such that the smooth inner surface engages an outer surface of the doorknob. The levers are directly engaged by a hand of a person rotating the knob.

Another doorknob adapter is proposed by U.S. Pat. No. 5,701,635 issued to Hawkes, and a device similar in construction is manufactured under the tradename BOOTEE DOORSTOP. These devices include an annular wall with a smooth inner surface that is formed of a resilient material.

Each of the above discussed devices is positioned over a doorknob in such a manner that the smooth inner surface engages an outer surface of the knob. When installed, a rear portion of the annular wall extends beyond the doorknob to thereby prevent the doorknob from contacting and damaging a wall when the door is swung open.

Installation of doorknob adapters with smooth inner surfaces, such as discussed above, can be a difficult task for people with debilitating hand conditions. This is because such types of adapters must be pressed and stretched over the doorknobs while faced with adverse frictional forces that are primarily intended to prevent relative movement of the adapter and the doorknob during turning operations. Removal of these types of adapters can also be a difficult task. Furthermore, the doorknob adapters or grippers formed with smooth inner surfaces can be used for engagement with the doorknobs having limited variation of outside dimensions.

Thus, it has been a long felt and unsolved need for a gripper or doorknob adapter which can be easily installed and operated by individuals having difficulty in exercising grasping force by their hands. There is also a need for an adapter which is capable of being used with a wide variety of sizes of the doorknobs, the adapter providing improved engagement between a hand of the user and exterior of the adapter.

SUMMARY OF THE INVENTION

According to the invention, a device for facilitating the turning of a knob, such as a doorknob, faucet knob, volume control knob, or the like, comprises a tubular body member with a continuous wall that defines an inner bore. The bore is adapted to receive a knob. At least one projection extends from the inner surface and into the bore. The continuous wall includes an outer gripping surface and the at least one projection is resiliently deformable upon engagement with an outer surface of the knob to thereby frictionally hold the outer surface of the knob.

In one embodiment, a plurality of projections is spaced along the inner surface of the wall. A distance between opposing pairs of projections is smaller than a cross dimension of the knob before installation of the device on the knob.

Each projection can include a pair of spaced end portions integrally formed with the inner surface of the wall. The outer gripping surface of the continuous wall can include a generally curved section between each pair of spaced end portions before the device is installed on the knob. In some embodiments of the invention, deformation of the projections upon installation of the device on the knob causes the spaced end portions of each projection to spread apart and at least partially straighten the generally curved sections to thereby create a multi-faceted outer gripping surface.

According to a further embodiment of the invention, a device for facilitating the turning of a knob comprises a tubular body member having a continuous wall defining an inner bore adapted for receiving a knob, the continuous wall including an outer gripping surface and an inner surface; and a plurality of spaced projections extending circumferentially around the inner surface. Each projection has an innermost portion that, combined with the other innermost portions, define a knob reception opening with a circumference that is smaller than a circumference of the knob before installation of the device on the knob. The projections are resiliently deformable upon engagement with an outer surface of the knob to thereby frictionally hold the tubular member on the knob.

According to an even further embodiment of the invention, the tubular member has opposite ends and an end wall formed at one of the ends. An opening formed in the end wall has a circumference that is less than the circumference of the knob reception opening.

The term "circumference" as used herein and in other parts of the specification, including the claims, refers to the distance around the perimeter of an object or opening, and is not to be limited to circles or other rounded surfaces, as other shapes fall within the meaning and scope of the invention.

There has thus been outlined the more readily apparent features of the invention so that the detailed description thereof that follows may be better understood, and so that the present contribution to the art may be better appreciated. There are, of course, additional features of the invention that will be described hereinafter which will form the subject matter of the appended claims. Those skilled in the art will appreciate that the preferred embodiments may readily be used as a basis for designing other structures, methods and systems for carrying out the several purposes of the present invention.

It is important, therefore, that the claims be regarded as including such equivalent constructions since they do not depart from the spirit and scope of the present invention.

DETAILED DESCRIPTION OF THE PREFERRED EMBODIMENT

Figure 1:
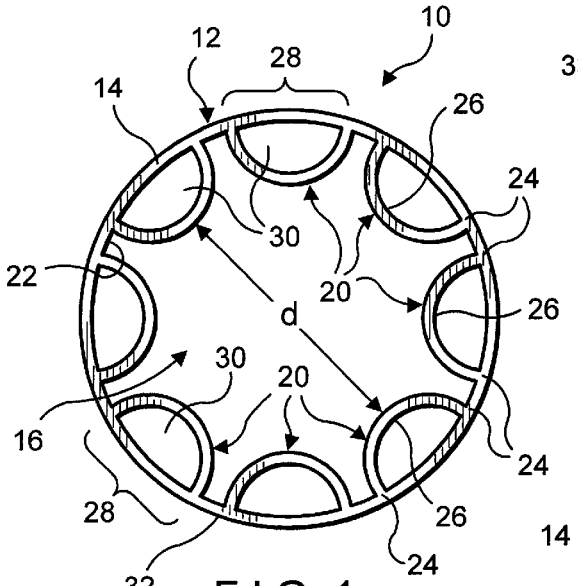
FIG. 1 is an end view of a doorknob adapter according to one embodiment of the invention.
Figure 2:
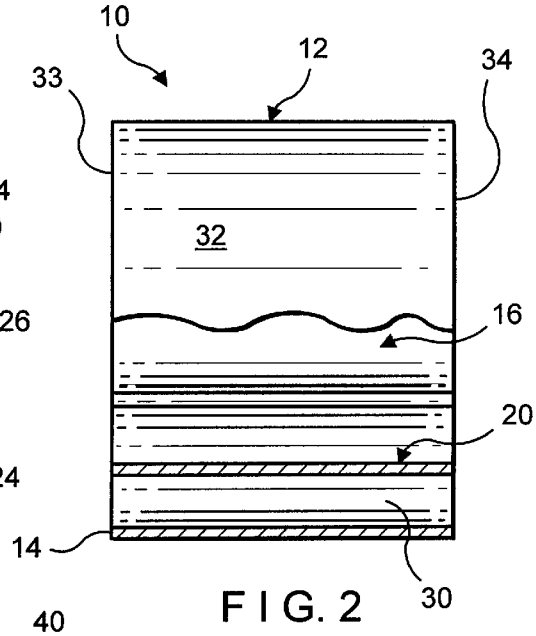
FIG. 2 is a side view in partial cross section of the doorknob adapter of FIG. 1.
Figure 5:
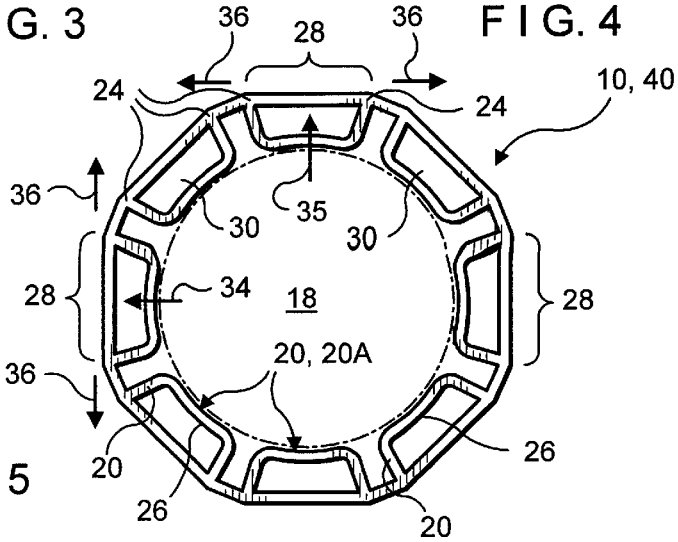
FIG. 5 is an end view of the doorknob adapters of FIGS. 1 and 3 installed on a doorknob.
Figure 6:
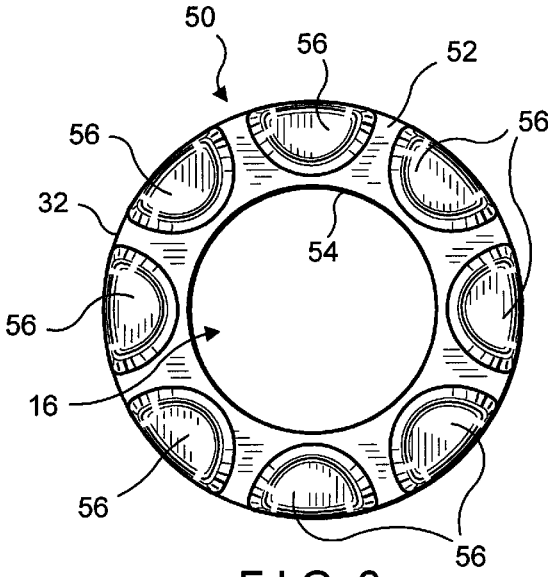
FIG. 6 is a rear end view of a doorknob adapter according to a further embodiment of the invention.
Figure 7:
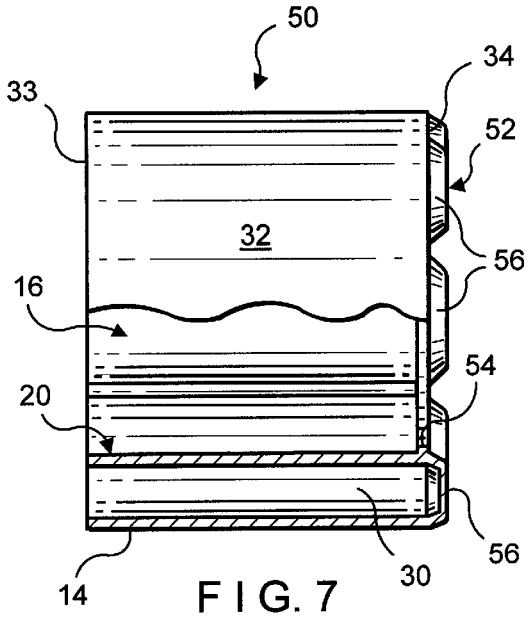
FIG. 7 is a side view in partial cross section of the doorknob adapter of FIG. 6.
Figure 8:
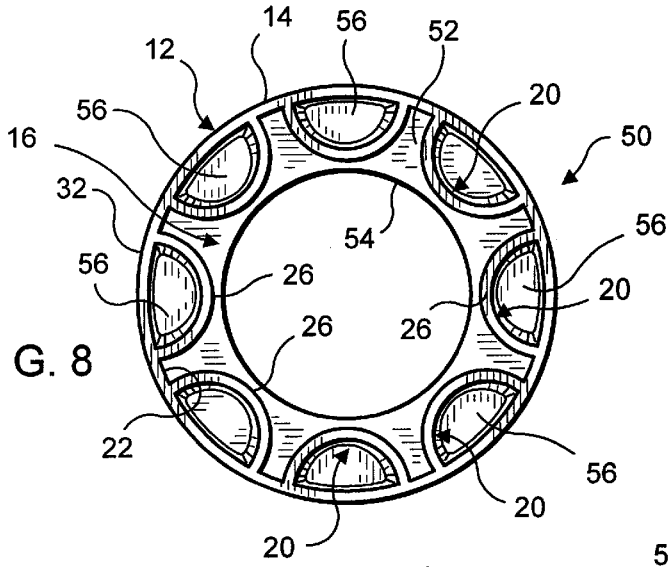
FIG. 8 is a front end view of the doorknob adapter of FIG. 6.
Figure 9:
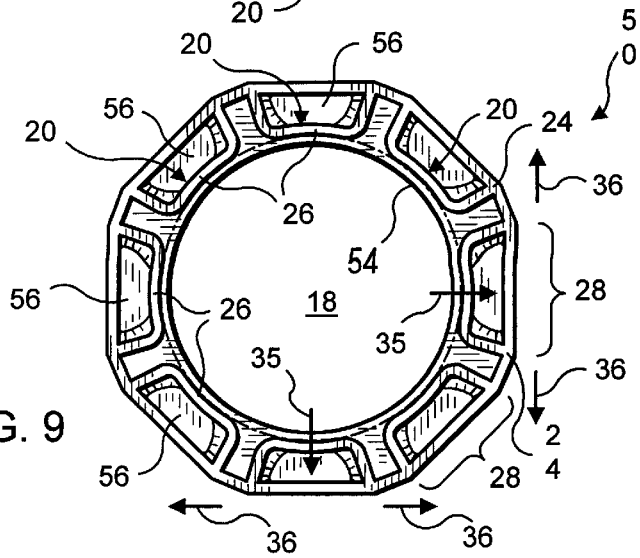
FIG. 9 is a front end view of the doorknob adapter of FIGS. 6–8 installed on a doorknob.

Referring now to the drawings in general, and to FIGS. 1 and 2 in particular, wherein an adapter 10 for installation over a doorknob or the like is best illustrated. The adapter 10 includes a tubular body member 12 with a continuous outer wall 14. The wall 14 can be substantially circular in cross section and defines an inner bore 16 that is sized to receive a doorknob 18 (shown in phantom line in FIG. 5) or the like. A plurality of projections 20 are formed integrally with the wall 14 on an inner surface 22 thereof. Although the projections 20 can be of any length sufficient for engagement with a doorknob, in the preferred embodiment, the projections extend from a first end 33 to a second end 34 of the tubular body member 12.

In the embodiment of FIGS. 1 and 2 each projection 20 is preferably semi-circular in cross section and includes opposing end portions 24 and an innermost curved portion 26 that extends inwardly toward an axial center of the bore 16 from the end portions. The gripping adapter of the invention is typically formed with a plurality of sections 28. In this respect, each section 28 of the outer wall between the opposing end portions 24 together with the corresponding projection 20 form an inner chamber 30. As best shown in FIG. 1, in one embodiment of the invention each wall section 28 is preferably arcuate in cross section before installation on the doorknob 18. An outer surface 32 of the tubular body member 12 forms a gripping surface that can be contacted by a hand of a user for turning the doorknob. As shown in FIG. 1, the outer surface 32 is preferably substantially smooth before installation on the doorknob.

The distance d between the opposing projections 20 is preferably less than a diameter or other cross-dimension of the doorknob 18. In this manner, when the adapter 10 is installed over a doorknob 18 (see FIG. 5, for example), the innermost portion 26 of each projection 20 collapses or deforms in a radial direction as represented by arrow 35, while the end portions 24 of each projection will be forced apart as represented by arrows 36, to thereby stretch the wall sections 28 between the end portions 24 into a substantially planar shape. Thus, in this embodiment the plurality of projections associated with the inner wall surface 22, enables the invention to transform the initially smooth outer surface 32 of the tubular member 12 into a multi-faceted outer surface (see FIG. 5). This arrangement enhances engagement between the hand of the user so as to provide additional friction and leverage for persons that may have difficulty in grasping the adapter 10 with the thumb and fingers. The deformable nature of the projections 20, and thus the inner chambers 30, facilitates installation of the adapter 10 on a doorknob or the like, and accommodates a variety of doorknob types and sizes. When the installed adapter 10 is grasped by the hand of a user, the outer wall 14 in general and the wall sections 28 in particular are also deformable inwardly toward their corresponding innermost portion 26 to provide cushioning and a better grip for the person.

The body member 12, including the wall 14 and projections 20, is preferably formed of a resilient material, such as polyvinyl chloride (PVC), polyurethane, rubber or other elastomeric material, etc., that is electrically insulative offering a suitable amount of frictional holding force once installed on the doorknob and springs back to its original shape when removed. The electrically insulative properties of the material prevent electrostatic shock that may otherwise occur with metallic doorknobs by isolating the doorknob from the person. The resilient nature of the projections function as resilient spring members that exert radially inward forces around the perimeter of the doorknob to thereby frictionally grasp the doorknob and remain stationary with respect to the doorknob during turning.

If desired, the stiffness of each projection 20 can be slightly greater than the stiffness of the outer wall 14 such that each projection exhibits a greater resistance to deformation than the outer wall. This can be accomplished by forming each projection 20 with a greater thickness than the outer wall 14.

Figure 3:
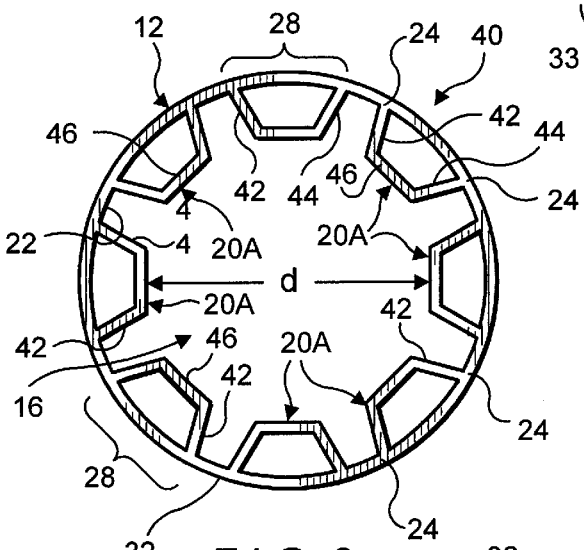
FIG. 3 is an end view of a doorknob adapter according to another embodiment of the invention.
Figure 4:
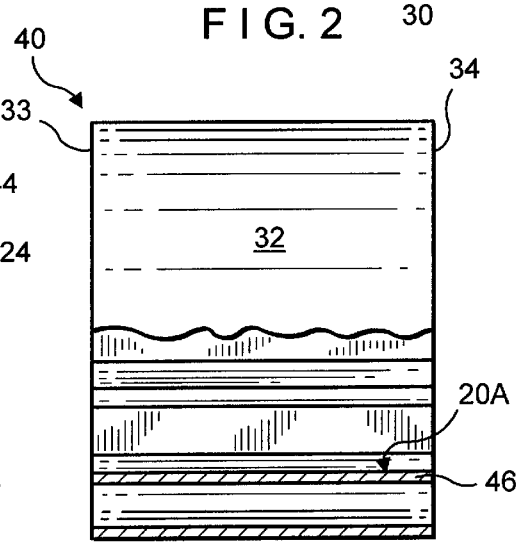
FIG. 4 is a side view in partial cross section of the doorknob adapter of FIG. 3.

With reference now to FIGS. 3 and 4, an adapter 40 for a doorknob or the like according to another embodiment of the invention is illustrated, wherein like parts in the previous embodiment are represented by like numerals. The adapter 40 is similar in construction to the adapter 10 previously described, with the exception that the projections 20 are replaced with projections 20A. Each of the projections 20A includes a pair of legs 42 and 44 formed integrally with the outer wall 14 at end portions 24 and extend inwardly from the inner surface 22 of the tubular body member 12. The legs 42 and 44 are oriented to converge toward each other and terminate at an innermost web portion 46. This arrangement forms a projection having a generally trapezoidal cross section.

As in the previous embodiment, the stiffness of each projection 20A can be slightly greater than the stiffness of the outer wall 14 and the distance d between opposing projections 20A is preferably less than a cross-dimension of the doorknob 18. In this manner, when the adapter 40 is installed over a doorknob 18 (See FIG. 5), the innermost portion 46 and the legs 42 and 44 of each projection 20A deforms in a radial direction as represented by the arrow 35, while the end portions 24 of each projection are forced apart as represented by arrows 36. Thus, the wall sections 28 between the end portions 24 are stretched into a substantially planar shape. In view of that, the initially smooth outer surface 32 of the tubular member 12 transforms into a multi-faceted outer surface.

Referring now to FIGS. 6–9, an adapter 50 for a doorknob or the like according to a further embodiment of the invention is illustrated, wherein like parts in the previous embodiments are represented by like numerals. The adapter 50 is similar in construction to the adapters 10 and 40 previously described, with the exception that an end wall 52 is formed at the end 34 of the tubular body member 12. The end wall 52 extends from the outer surface 32 of the tubular body member 12 and includes an opening 54 that communicates with the inner bore 16.

Preferably, the diameter of the opening 54 is less than the diameter defined by the undeformed innermost portions 26 to thereby limit how far the adapter 50 can be slid onto the doorknob. An end cap 56 is formed in the end wall 52 over each projection 20. The end wall 52, including the end caps 56, assists in maintaining the original shape of the tubular body end 34 when the adapter 50 is installed on a doorknob, so as to enhance aesthetic appearance of the invention.

As in the previous embodiments, the stiffness of each projection 20 can be slightly greater than the stiffness of the wall 14. Furthermore, the distance between opposing projections 20 is preferably less than a cross-dimension of the doorknob 18. This enables the invention to transform the outer surface 32 of the tubular member 12 into a multi-faceted outer surface when installed on the doorknob.

Each of the projections 20 includes opposing end portions 24 and an innermost curved portion 26 extending toward the axial center of the bore 16.

Figure 10:
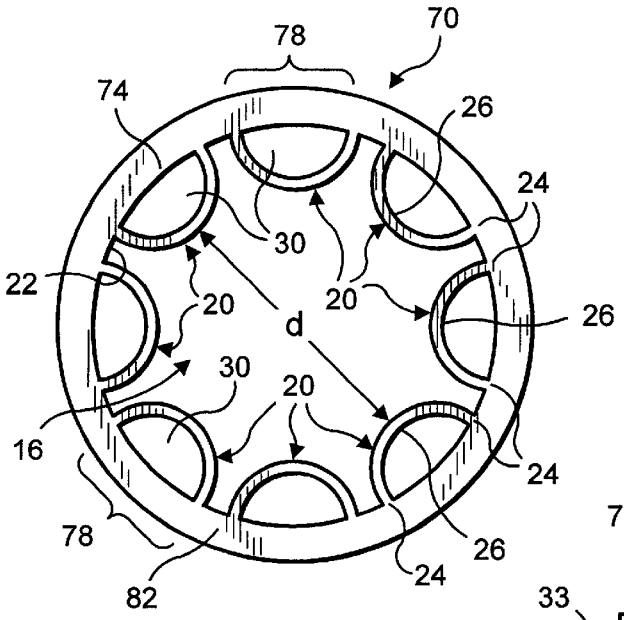
FIG. 10 is an end view of a doorknob adapter according to a still further embodiment of the invention.
Figure 11:
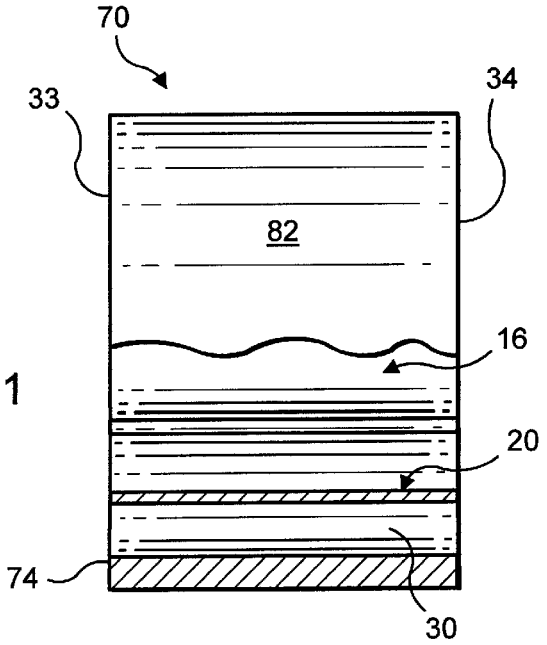
FIG. 11 is a side view in partial cross section of the doorknob adapter of FIG. 10.
Figure 12:
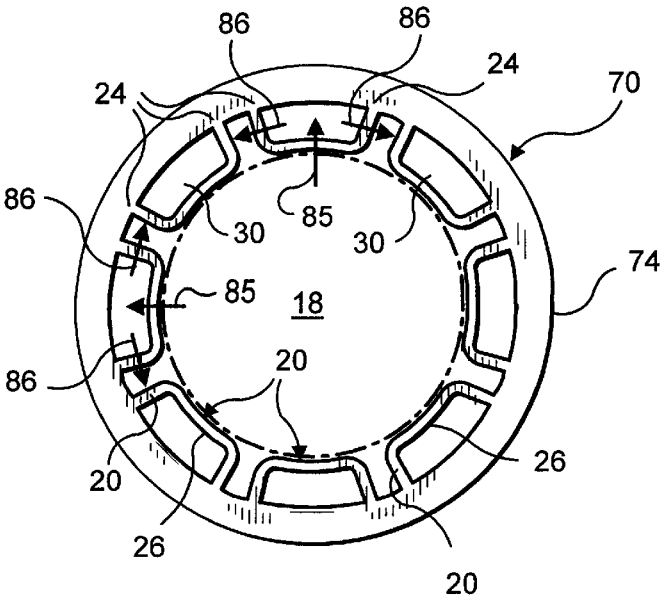
FIG. 12 is an end view of the doorknob adapter of FIGS. 10 and 11 installed on a doorknob.

With reference now to FIGS. 10–12 , an adapter 70 for a doorknob or the like according to a still further embodiment of the invention is illustrated, wherein similar parts in the previous embodiments are represented by similar numerals. The adapter 70 is similar in construction to the adapter 10 previously described. However, the stiffness of the outer wall 74 is slightly greater than the stiffness of each projection 20. This can be accomplished by forming the outer wall 74 with a greater thickness than the projections 20.

Similar to the previous embodiments, the distance d between the opposing projections 20 is less than the cross-dimension of the doorknob 18. Thus, when the adapter 70 is installed over a doorknob 18 (see FIG. 12), the innermost portion 26 of each projection 20 deforms in a radial direction as represented by arrow 85. In this manner the end portions 24 of each projection are forced apart as represented by arrows 86, to thereby stretch the inner area of the wall 74 between the end portions 24 into a substantially elongated shape. However, in this embodiment the outer surface 82 remains substantially smooth after installation on the doorknob.

Although a definite number of projections are shown in each of the above embodiments, it is to be understood that more or less projections may be provided. Also, the height, length, thickness and shape of each projection, as well as the diameter, length, thickness and shape of the tubular body member 12, can be modified based on the type of knob that the adapter is to be slipped over, and the reduced amount of turning force desired.

Moreover, although the above description particularly discloses the adapter utilized with doorknobs, it is to be understood that the adapter of the invention can be used with other types of rotating knobs, such as faucet knobs, volume control knobs, etc., and can be readily adaptable to knobs of various sizes and shapes. While the invention has been taught with specific reference to these embodiments, those skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A device for facilitating turning of a knob, comprising:

a tubular body member having a continuous wall defining an inner bore adapted for receiving a knob, the continuous wall including an outer gripping surface and an inner surface; the tubular body member extending between a free end and a front end wall;

a plurality of projections positioned at spaced intervals on the inner surface and extending into the bore, each projection is formed with a pair of spaced end portions and having an innermost portion that together define a knob reception opening, the projections being resiliently deformable upon engagement with an outer surface of the knob to thereby frictionally hold the tubular member on the knob; and each said projection extending between an open portion provided at the free end of the tubular member and a front portion, so that the front portion of each said projection terminates at an individual wall which extends outwardly from the front end wall of the tubular member.

2. A device according to claim 1, wherein each projection is generally semi-circular in cross-section.

3. A device according to claim 1, wherein each projection is generally trapezoidal in cross-section.

4. A device according to claim 1, wherein each said individual wall closes the front portion of the respective projection.

5. A device according to claim 1, wherein a distance between opposing projections before installation of the device on the knob is smaller than a cross dimension of the knob.

6. A device according to claim 5, wherein the outer gripping surface of the continuous wall includes a generally curved section between each pair of spaced end portions before installation of the device on the knob, and further wherein deformation of the projections upon installation of the device on the knob causes the spaced end portions to spread apart and at least partially straighten the generally curved sections to thereby create a multi-faceted outer gripping surface.

7. A device according to claim 1, wherein said plurality of projections comprises at least one opposing pair of projections, and further wherein a distance between said at least one opposing pair of projections of the device on the knob is smaller than a cross dimension of the knob.

8. A device according to claim 7, wherein each projection includes a pair of spaced end portions integrally formed with the inner surface of the wall.

9. A device according to claim 8, wherein the outer gripping surface of the continuous wall includes a generally curved section between each pair of spaced end portions before installation of the device on the knob, and further wherein deformation of the projections upon installation of the device on the knob causes the spaced end portions to spread apart and at least partially straighten the generally curved sections to thereby create a multi-faceted outer gripping surface.

10. A device according to claim 9, wherein the tubular member has opposite ends, and further wherein each projection extends along the inner surface between the opposite ends.

11. A device according to claim 1, wherein the outer gripping surface of the continuous wall includes a generally curved section between each pair of spaced end portions before installation of the device on the knob, and further wherein deformation of the projections upon installation of the device on the knob causes the spaced end portions to spread apart and frictionally embrace the knob.

12. A device according to claim 11, wherein the deformation of the projections at least partially straighten the generally curved sections to thereby create a multifaceted outer gripping surface.

13. A device according to claim 12, and further comprising an opening extending through the front end wall, a circumference of the opening being less than the circumference of the knob reception opening.

14. A device for facilitating turning of a knob, comprising:

a tubular body member having a continuous wall defining an inner bore adapted for receiving a knob, the continuous wall including an outer gripping surface and an inner surface, the tubular member extending between a free end and a front end wall;

a plurality of projections positioned at spaced intervals on the inner surface and extending into the bore, each projection is formed with a pair of spaced end portions and having an innermost portion that together define a knob reception opening that is smaller than an outer dimension of the knob before installation of the device on the knob, the projections being resiliently deformable upon engagement with an outer surface of the knob to thereby frictionally hold the tubular member on the knob; and each projection extending between an open portion provided at the free end of the tubular member and a front portion, so that the front portion of each said projection terminates at an individual wall closing the respective projection and extending outwardly from the front end wall of the tubular member;

wherein the outer gripping surface of the continuous wall includes a generally curved section between each pair of spaced end portions before installation of the device on the knob, and further wherein deformation of the projections upon installation of the device on the knob causes the spaced end portions to spread apart and frictionally embrace the knob.

* * * * *